United States Patent [19]

Richeson, Jr.

[11] Patent Number: 4,831,973

[45] Date of Patent: May 23, 1989

[54] REPULSION ACTUATED POTENTIAL ENERGY DRIVEN VALVE MECHANISM

[75] Inventor: William E. Richeson, Jr., Fort Wayne, Ind.

[73] Assignee: Magnavox Government and Industrial Electronics Company, Fort Wayne, Ind.

[21] Appl. No.: 153,154

[22] Filed: Feb. 8, 1988

[51] Int. Cl.[4] ..... F01L 9/04

[52] U.S. Cl. ..... 123/90.11; 251/129.10; 335/234

[58] Field of Search ..... 123/90.11, 90.12, 90.13, 123/90.14; 251/65, 129.09, 129.10, 337; 361/143, 147, 159, 167, 192, 194; 335/234

[56] References Cited

U.S. PATENT DOCUMENTS

| | | | |
|---|---|---|---|
| 3,738,337 | 6/1973 | Massie | 123/90.11 X |
| 3,741,176 | 6/1973 | Schmidt et al. | 123/90.14 |
| 4,072,918 | 2/1978 | Read, Jr. | 335/234 X |
| 4,393,832 | 7/1983 | Samuel et al. | 123/90.14 X |
| 4,614,170 | 9/1986 | Pischinger et al. | 123/90.11 |
| 4,683,452 | 7/1987 | Henley | 335/234 |
| 4,715,331 | 12/1987 | Kreuter | 251/129.1 |
| 4,715,332 | 12/1987 | Kreuter | 251/129.1 |
| 4,749,167 | 6/1988 | Gottschall | 251/65 |
| 4,779,582 | 10/1988 | Lequesne | 335/234 X |

*Primary Examiner*—Willis R. Wolfe

*Attorney, Agent, or Firm*—Roger M. Rickert; Thomas A. Briody; Richard T. Seeger

[57] ABSTRACT

A bistable electronically controlled transducer having an armature reciprocable between first and second positions is disclosed including either a stressed spring or compresed air within a closed chamber in the transducer for causing the armature to move, and a permanent magnet latching arrangement for holding the armature in either one of the positions. An electromagnetic repulsion motor overpowers the effect of the permanent magnet latching arrangement releasing the armature to move from one to the other of the positions. The transducer finds particular utility as an actuator mechanism for moving internal combustion engine valves.

10 Claims, 5 Drawing Sheets

REPULSION ACTUATED POTENTIAL ENERGY DRIVEN VALVE MECHANISM

SUMMARY OF THE INVENTION

The present invention relates generally to a two position, straight line motion actuator and more particularly to a fast acting actuator which utilizes potential energy against an armature to perform extremely fast transit times between the two positions.

This actuator functions as a bistable transducer and finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves.

The actuator mechanism may find numerous other applications such as in compressor valving and valving in other hydraulic or pneumatic devices, or as a fast acting control valve for fluidic actuators or mechanical actuators where fast controlled action is required such as moving items in a production line environment.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the time best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

In copending application Ser. No. 021,195 entitled ELECTROMAGNETIC VALVE ACTUATOR, filed Mar. 3, 1987 in the name of William E. Richeson and assigned to the assignee of the present application, now U.S. Pat. No. 7,794,890, there is disclosed a valve actuator which has permanent magnet latching at the open and closed positions. Electromagnetic repulsion may be employed to cause the valve to move from one position to the other. Several damping and energy recovery schemes are also included.

In copending application Ser. No. 153,257, entitled PNEUMATIC ELECTRONIC VALVE ACTUATOR, filed on even date herewith in the names of William E. Richeson and Frederick L. Erickson, still pending, there is discloses a somewhat similar valve actuating device which employs a release type mechanism rather than a repulsion scheme as in the previously identified copending application. The disclosed device in this application is a truly pneumatically powered valve with high pressure air supply and control valving to use the air for both damping and as the primary motive force. This application also disclosed different operating modes including delayed intake valve closure and a six stroke cycle mode of operation.

Other related applications all assigned to the assignee of the present invention and filed on even date herewith are Ser. No. 153,262 (William E. Richeson) POTENTIAL ENERGY DRIVEN VALVE MECHANISM where energy is stored from one valve motion to power the next, still pending, and Ser. No. 153,155 (William E. Richeson and Frederick L. Erickson) PNEUMATICALLY POWERED VALVE ACTUATOR is still pending. One distinguishing feature of this last application is that control valves and latching plates have been separated from the primary working piston to provide both lower latching forces and reduced mass resulting in faster operating speeds. One distinguishing feature of the POTENTIAL ENERGY DRIVEN VALVE MECHANISM application is the fact that initial accelerating force is not due to electromagnetic repulsion, but, rather, a release concept somewhat like that employed in the second abovementioned copending application is employed. Such a release structure utilizes a coil in close proximity to the holding magnet which, when energized, neutralizes the field of the magnet allowing some other force to accelerate the armature.

In the present invention, a coil separated from the holding magnet is energized to induce a current in a conductive plate proximate the coil. The magnetic field of the coil and the magnetic field created by the induced field oppose one another and a strong repulsion forcing the plate away from the coil is achieved. The present invention and the POTENTIAL ENERGY DRIVEN VALVE MECHANISM application represent tradeoffs in that the present invention requires more energy to operate, but achieves a more rapid response of the engine valve.

In the first two referenced copending applications, numerous advantages and operating mode variations suitable for incorporation with the present valve actuator are disclosed and the entire disclosures of all four of these applications are specifically incorporated herein by reference.

Among the several objects of the present invention may be noted the provision of a valve actuating mechanism wherein potential energy is stored within the mechanism preparatory to subsequent actuation thereof and released by an electromagnetically induced sudden propulsive force; the provision of an electromagnetic latching device for an actuator which is unlatched by overpowering the latching force of the magnetic field; the provision of a compression (pneumatic or spring) driven valve actuating mechanism; the provision of a valve actuating mechanism of improved response time; The provision of a compact valve actuating mechanism; the provision of a bistable electronically controlled transducer which utilizes potential energy stored in the transducer from the previous transition from one stable state along with a strong initial repulsive force to the other to power the next transition; the provision of a valve actuating mechanism in accordance with the previous object which is more rapidly and easily accelerated and decelerated; and the provisions of a simplistic hydraulic damper with lost motion coupling to a valve actuating device for slowing the motion of the valve actuating device near either extreme of its motion. These as well as other objects and advantageous features of the present invention will be in part apparent and in part pointed out hereinafter.

In general, an electronically controllable valve mechanism for use in an internal combustion engine has an engine valve with an elongated valve stem and motive means, in the form of either a stressed spring or air compressed in a cavity, for causing the valve to move in the direction of stem elongation between valve-open and valve-closed positions along with a magnetic latching arrangement for holding the valve in each of the valve-open and valve-closed positions. A coil is energized to override the magnetic latching arrangement and dislodge the valve from the position in which it was held. The coil functions as part of an electromagnetic repulsion arrangement which includes, in addition to the relatively fixed coil, an annular conductor fixed to and movable with the valve stem and juxtaposed with the coil when the valve is in one of the valve-open and valve-closed positions, and electrical circuitry for providing a sudden current through the coil. The sudden current induces a current in the annular conductor the resulting field of which opposes the field caused by the current flow in the coil and the two magnetic fields cooperate to thrust the conductor away from the coil.

Also in general and in one form of the invention, a bistable electronically controlled transducer has an armature reciprocable between first and second positions, a stored energy arrangement for causing the armature to move, a permanent magnet latch for holding the armature in one of the positions, and an electromagnetic repulsion arrangement operable when energized to override the magnetic latching arrangement and dislodge the armature from the position in which it was held.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
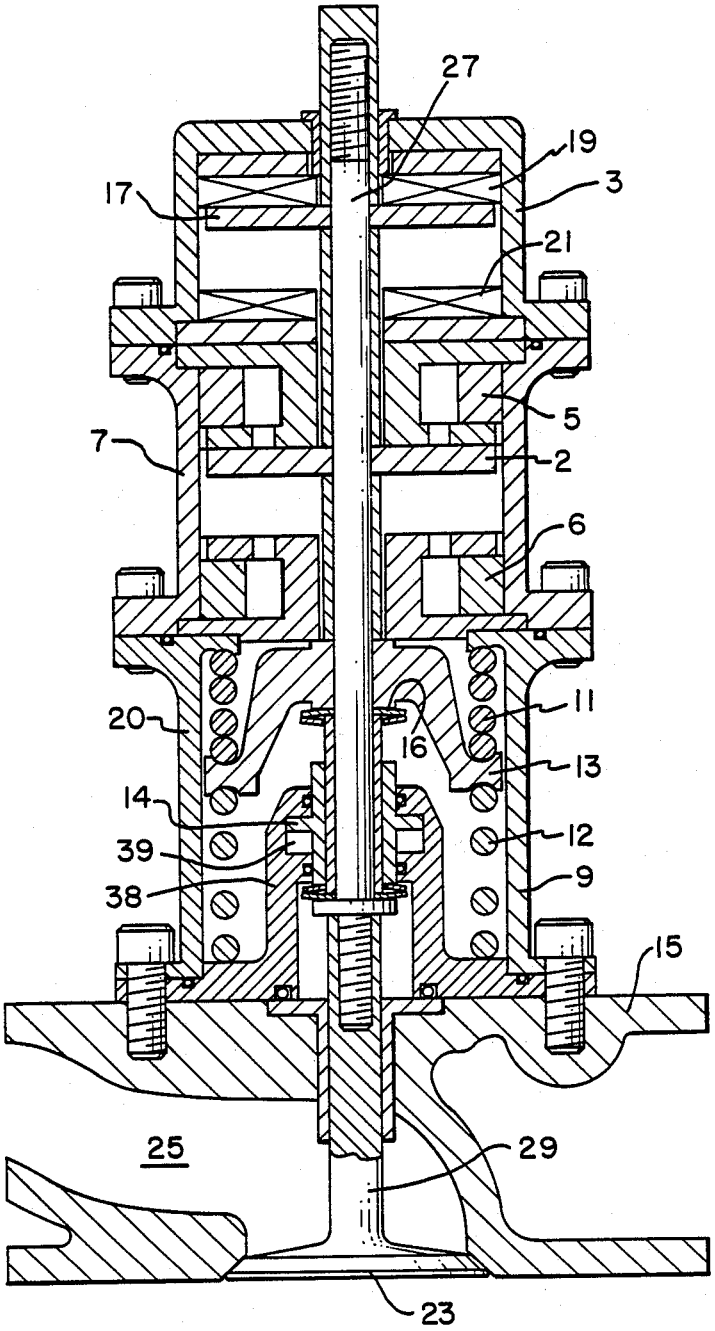
FIG. 1 is a view in cross-section of an engine valve and valve actuating mechanism in the valve-closed position.
Figure 2:
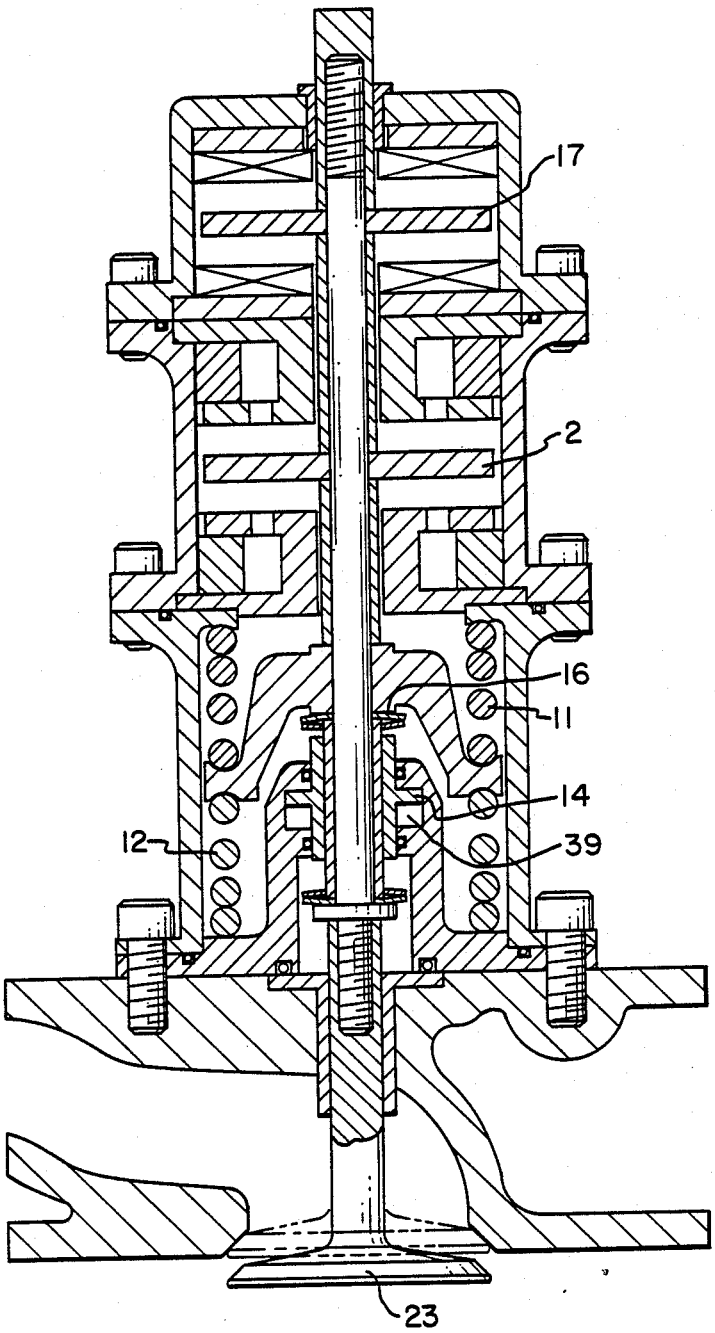
FIG. 2 is a view similar to FIG. 1, but showing the mechanism midway between valve-closed and valve-open positions.
Figure 3:
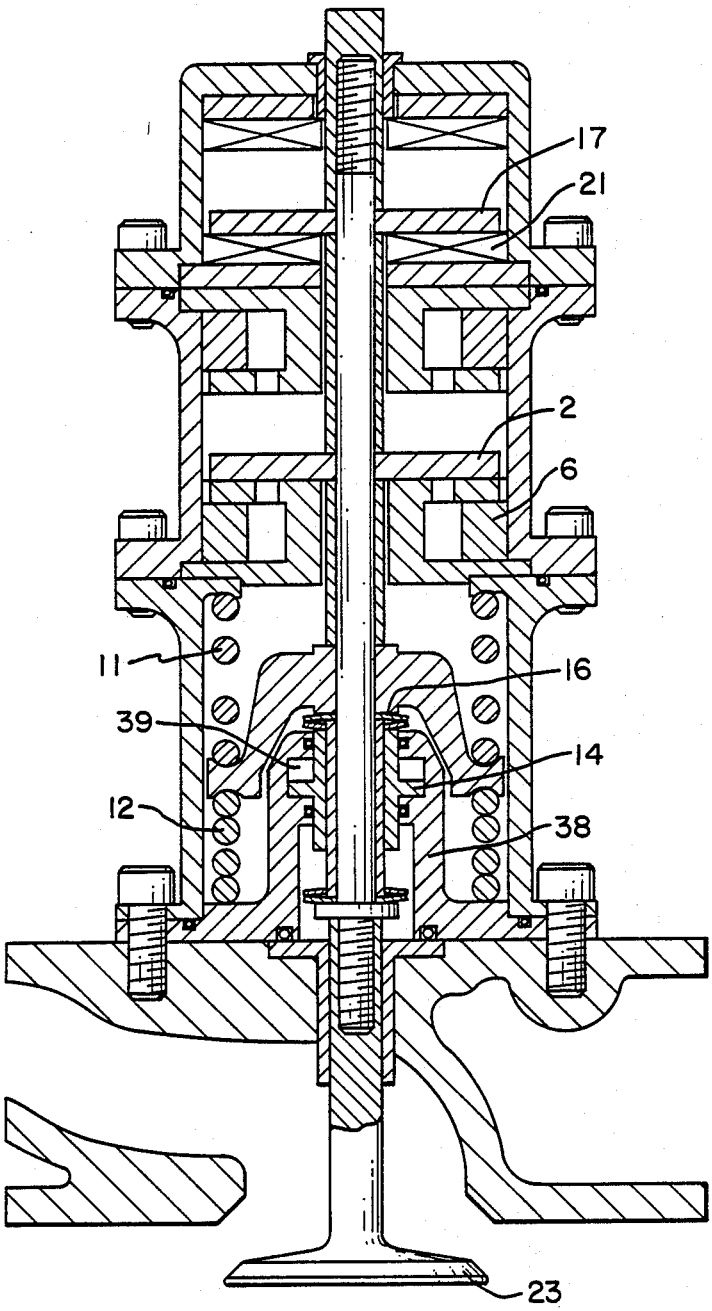
FIG. 3 is a view similar to FIGS. 1 and 2, but showing the mechanism in the valve-open position.

The valve actuator or transducer of FIGS. 1–3 comprises four modules each contained within a housing portion 3, 7, 9 or 38 appropriately coupled together with bolts and seals to a head 15 or other portion of an exemplary internal combustion engine. The upper module contains a copper or other conductive propulsion disk 17 which travels between two propulsion coils 19 and 21. Disk 17 is fixed to an armature 27 which is an extension of the valve stem 29. The center module includes a soft magnetic disk 2 also fixed to the armature. Disk 2 travels between latching magnets 5 and 6. The lower module within housing portion 9 includes spring portions 11 and 12 which store potential energy for powering the transducer. A final module within the lower module includes a housing abutment 38 and a damping piston 14 which functions to slow the armature near the ends of its travel by fluid displacement.

FIG. 1 illustrates a conventional internal combustion engine poppet valve 23 for selectively opening communication between an engine cylinder and an intake or exhaust manifold 25. The valve is shown in FIG. 1 in its closed or full up and seated position. The valve actuator has a movable armature 27 reciprocable coaxially with valve stem 29 for opening and closing the valve. The armature includes a soft magnetic steel latching disk 2 which travels between latching magnets 5 and 6. The armature 27 is spring biased toward the neutral position of FIG. 2 by spring portions 11 and 12 and mechanically connected to those springs by a web or spindle 13. The spring portions 11 and 12 function as a means for continuously urging the armature 27 away from the position in which it is maintained by the latching magnets 5 as in FIG. 1 or 6 as in FIG. 3. The helical spring has one portion 11 compressed and another portion 12 which is stretched in FIG. 1 while the spring portion which was compressed becomes stretched and the spring portion which was stretched becomes compressed when the armature moves from the position of FIG. 1 to the position of FIG. 3.

Figure 5:
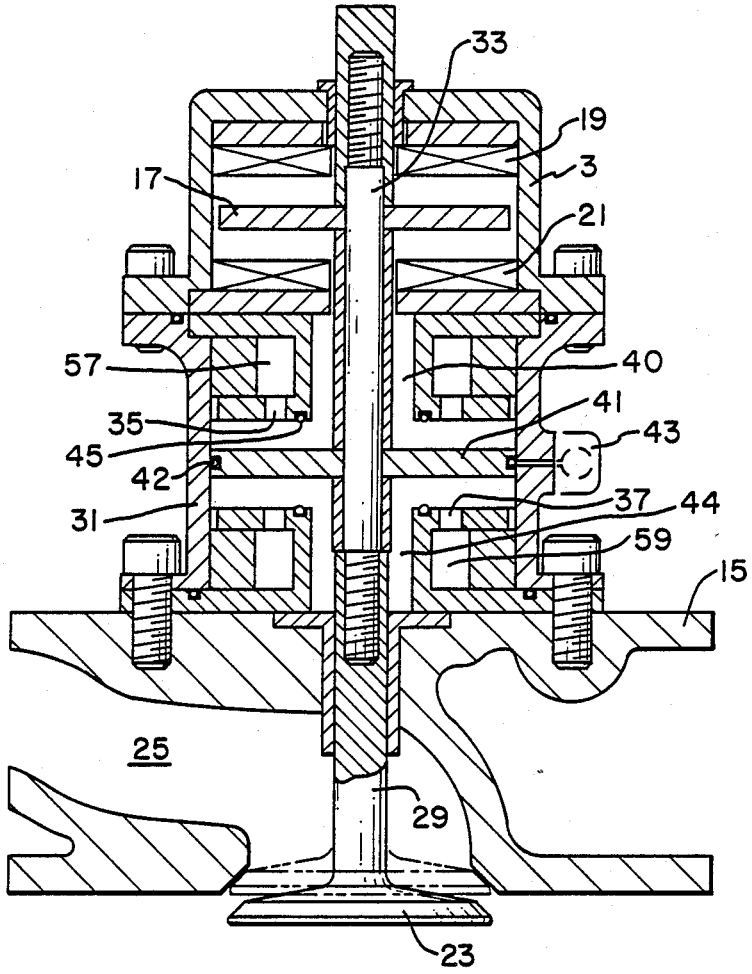
FIG. 5 illustrates a variation on the actuating mechanism of FIGS 1–3. Corresponding reference characters indicate corresponding parts throughout the several views of the drawing.

The function of continuously urging the armature away from the position in which it is latched is provided in FIG. 5 by a housing 31, a piston 41 coupled to the armature 33 and air compressed by the piston within the housing in chamber 40 when the valve is closed and in chamber 44 when the valve is open. A damping piston 14 is coupled by a lost motion coupling to the armature 27 for rapidly decelerating the valve shaft toward the extremes of its travel by displacing fluid within the chamber 39.

A high latching force is provided by the attractive force of permanent magnet 5 on disk or plate 2 holding that plate in the up or valve-closed position. The same type latching is provided by permanent magnet 6 when holding disk 2 in the full down or valve-open position as shown in FIG. 3. The controlled release of one of the latches is achieved by a repulsion motor contained within the upper housing 3. The repulsion motor comprises a pair of implanted windings 19 and 21 which are capable of imparting a very high initial repulsive force to the copper disk 17. This force disables or overpowers the latching causing the valve to transit from one position to the other. In FIG. 1 with the valve closed, the electrically conductive disk 17 is juxtaposed with the upper coil 19, a current is induced in the disk 17. The magnetic fields of the coil and disk oppose one another and the high repulsive force on the disk causes the armature to rapidly accelerate under the urging of the spring assembly 11 and 12 within the housing 20. As the armature passes the center or neutral position of FIG. 2, the spring assembly will begin to retard the velocity of the valve until the latching disk 2 comes into close proximity with the opposite latching magnet at which time the high attractive force of the magnet will overcome the deceleration force of the spring on the armature. This high magnetic attraction would cause a significant impact condition to occur between the latching disk 2 and the latching magnet if the velocity of the armature and valve was not substantially reduced by an independent damping device. The incorporation of damping provisions in the housing 20 will assure controlled deceleration and low impact velocity of the latching disk with the magnet.

From a theoretical standpoint and assuming no friction, the springs 11 and 12 can provide an independent means of transporting the valve from one position to the next position with no additional motive force required. All that is required in this case is a means to release the valve from the first position and to catch and latch the valve in the second position. However, since the actual assembly has some discrete friction, and since the spring mass response time is not high enough by itself to meet the system requirements, the repulsion motor provides a high helping force which assures the fast transit times required. Therefore, the combination of the force from the repulsion motor to overcome the latching forces and the high initial force stored in the spring are combined to provide transit times between extreme positions of about two milliseconds.

The valve is illustrated in FIG. 2 in a mid way position and is traveling at near its peak velocity. There are no accelerating or decelerating forces acting on the valve at this time.

As the armature nears one of its extreme positions, say the valve-open position, belville washer 16 engages the small reciprocable piston 14 moving that piston downwardly within the oil filled chamber 39 to provide a significant retarding of damping force on the armature.

FIG. 3 shows the valve in the full down and latched position after being safely decelerated by the damper assembly and the spring 12. Upon reaching this full down position, the valve is immediately ready to be released to transit back to the closed position. The force of repulsion from coil 21 overpowers the latch and that force along with the force of spring 12 causes rapid transit of the valve upwardly.

Figure 4:
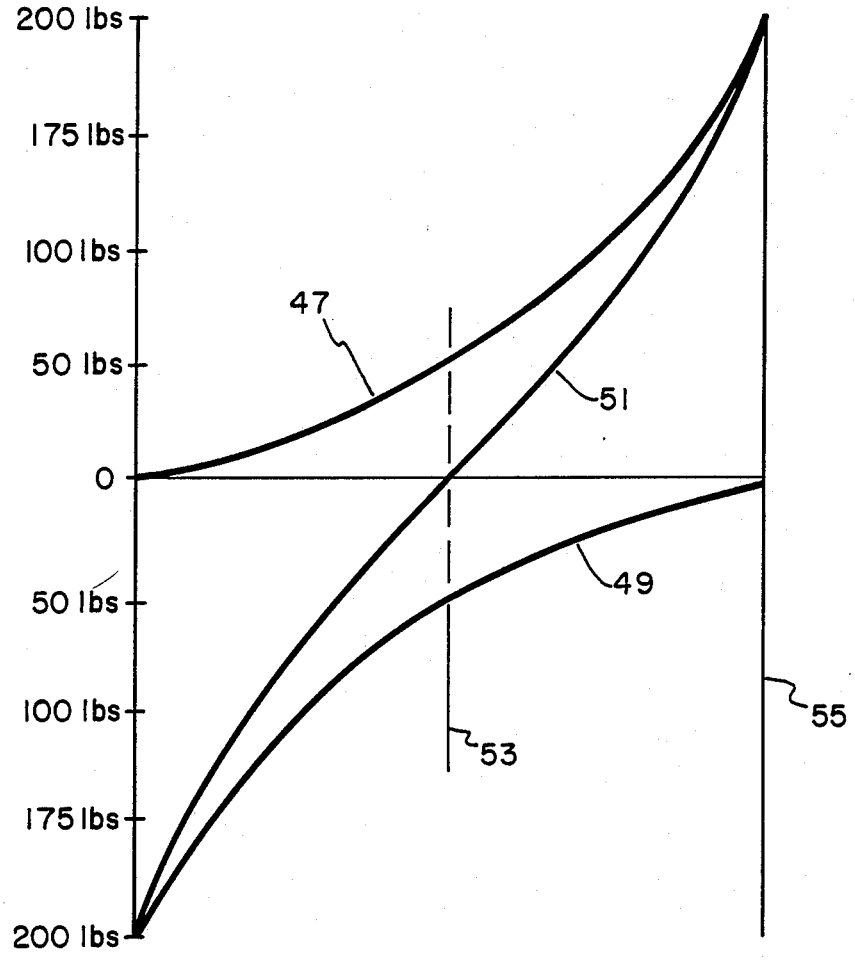
FIG. 4 illustrates the spring forces acting on the mechanism when moving between the positions shown in FIGS. 2 and 3.

FIG. 4 illustrates force/deflection curves for the individual springs and their resultant for the overall energy recovery spring assembly. Curve 47 corresponds to spring 11 and curve 49 corresponds to spring 12. The y-axis corresponds to the full down position of FIG. 3 while vertical line 53 is associated with the zero net spring force position of FIG. 2 and vertical line 55 is associated with the full up or valve closed position of FIG. 1. The total distance the valve moves is typically about four tenths of an inch. Notice that the two springs are nonlinear with the force increasing somewhat exponentially with increased deflection. This feature better matches the maximum deflection characteristics of the springs with the nonlinear forces associated with the magnetic latches. The two springs work together so that the net spring force on the valve is shown by curve 51.

In FIG. 5, a pneumatic spring assembly has been substituted for the mechanical spring of FIGS. 1–3. In this embodiment, the entire pneumatic spring assembly and damper has been incorporated into and made a part of the latching module. The latching disk 2 of FIGS. 1–3 provided only the latching function. The disk 41 of FIG. 6 provides the latching function as previously discussed as well as functioning as a nonlinear, low mass pneumatic spring, and as a damping device to effectively slow the armature as the valve nears either of its two extreme positions. The upper repulsion module functions as previously described.

The latching disk 41 has a circular seal 42 which keeps the upper pressure chamber 40 sealed relative to the lower pressure chamber 44. Chambers 40 and 44 are also utilized as "bounce" chambers in which the air is trapped and compressed as the latching disk 41 nears and then latches with one of the magnetic latches. The compressed air in the chambers provides the stored potential energy and accelerating force on the disk after actuation which was provided by the springs in the embodiment of FIGS. 1–3. A motion damping provision is also included to slow the armature motion as disk 41 approaches one of the magnetic latches. A circular seal 45 contacts disk 41 a short distance before latching occurs and a small quantity of air is trapped between the disk and the magnet assembly. This small quantity of air is compressed to a pressure exceeding that in chamber 40 (or 44) and vented into that chamber or other pressure reservoirs or chambers such as 57 and 59 through several small orifices such as 35 and 37 at a controlled rate. This throttling loss provides a controlled slowing of the valve shaft to an acceptable low impact velocity prior to latching. Some small air leakage will occur in the system and air supply fitting 43 includes a one-way valve which allows air to enter either chamber (depending on the position of piston 41) to replenish the air within the chambers. Air pressure to the fitting 43 can be controlled to easily change the "spring" rates.

From the foregoing, it is now apparent that a novel valve actuating arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An electronically controllable valve mechanism for use in an internal combustion engine comprising:

an engine valve having an elongated valve stem;

motive means for causing the valve to move in the direction of stem elongation between valve-open and valve-closed positions;

magnetic latching means for holding the valve in each of the valve-open and valve-closed positions, the motive means continuously urging the valve away from the position in which it is held by the magnetic latching means; and an electromagnetic repulsion arrangement operable when energized to supplement the motive means and override the magnetic latching means thereby dislodging the valve from the position in which it was held.

2. The electronically controllable valve mechanism of claim 1 wherein the electromagnetic repulsion arrangement includes a relatively fixed coil, an annular conductor movable with the valve stem and juxtaposed with the coil when the valve is in one of the valve-open and valve-closed positions, and electrical circuitry for providing a sudden current through the coil.

3. The electronically controllable valve mechanism of claim 1 wherein the motive means comprises a housing, a piston coupled to the valve and air compressed by the piston within the housing.

4. The electronically controllable valve mechanism of claim 1 wherein the motive means comprises a stressed helical spring having nonlinear force-deflection characteristics.

5. The bistable electronically controlled transducer of claim 4 wherein the means for continuously urging comprises a helical spring one portion of which is compressed and another portion of which is stretched.

6. A bistable electronically controlled transducer having an armature reciprocable between first and second positions, motive means for causing the armature to move, a permanent magnet latching arrangement for holding the armature in one of said positions, and an electromagnetic repulsion arrangement operable when energized to override the magnetic latching arrangement and dislodge the armature from the position in which it was held, the motive means exerting a force on the armature when in said one position which is less than and opposes the force of the permanent magnet latching arrangment holding the armature in said one position, the electromagnetic repulsion arrangement, when energized, providing an additional force opposing the force of the permanent magnet latching arrangement to dislodge the armature.

7. The bistable electronically controlled transducer of claim 6 wherein the motive means includes means for continuously urging the armature away from the position in which it is maintained by the latching arrangement.

8. The bistable electronically controlled transducer of claim 7 wherein the means for continuously urging comprises a helical spring one portion of which is compressed and another portion of which is stretched.

9. The bistable electronically controlled transducer of claim 8 wherein the spring portion which was compressed becomes stretched and the spring portion which was stretched becomes compressed when the armature moves from one position to the other.

10. The bistable electronically controlled transducer of claim 7 wherein the means for continuously urging comprises a housing, a piston coupled to the armature and air compressed by the piston within housing forming a low mass pneumatic spring.

* * * * *